US010099395B2

(12) United States Patent
Ferreira

(10) Patent No.: US 10,099,395 B2
(45) Date of Patent: Oct. 16, 2018

(54) CONDIMENT PACKAGE OPENING DEVICE

(71) Applicant: Joao Ferreira, Yonkers, NY (US)

(72) Inventor: Joao Ferreira, Yonkers, NY (US)

( * ) Notice: Subject to any disclaimer, the term of this patent is extended or adjusted under 35 U.S.C. 154(b) by 0 days.

(21) Appl. No.: 15/407,312

(22) Filed: Jan. 17, 2017

(65) Prior Publication Data

US 2018/0200904 A1 Jul. 19, 2018

(51) Int. Cl.

| | |
|---|---|
| ***B26D 1/00*** | (2006.01) |
| ***B26D 7/00*** | (2006.01) |
| ***B67B 7/00*** | (2006.01) |
| ***B26D 1/02*** | (2006.01) |
| ***B26D 7/18*** | (2006.01) |

(52) U.S. Cl.
CPC ..... *B26D 1/025* (2013.01); *B26D 7/18* (2013.01)

(58) Field of Classification Search
CPC ..... B26D 1/025; B26D 7/18
USPC ..... 30/124, 278, 280
See application file for complete search history.

(56) References Cited

U.S. PATENT DOCUMENTS

| | | | | |
|---|---|---|---|---|
| 2,881,520 | A * | 4/1959 | Mito | B26B 27/00 30/2 |
| 4,159,568 | A * | 7/1979 | Berner | B65D 85/42 30/124 |
| 4,711,031 | A * | 12/1987 | Annello | B26B 27/00 30/2 |
| 5,101,562 | A * | 4/1992 | Horvath | A47J 43/28 222/106 |
| D370,412 | S | 6/1996 | Rohrer | |
| 5,752,319 | A * | 5/1998 | Su | B67B 7/30 30/294 |
| 5,765,288 | A * | 6/1998 | Hagler, Jr. | B26B 5/005 30/280 |
| 6,263,772 | B1 * | 7/2001 | Navot | B67B 7/24 222/103 |
| 7,891,100 | B2 * | 2/2011 | Gelardi | B65D 77/24 30/124 |
| 8,887,957 | B2 | 11/2014 | Robinson | |
| 8,960,478 | B2 | 2/2015 | Crye | |
| 9,221,664 | B2 * | 12/2015 | Votolato | B67B 7/30 |
| 2006/0138017 | A1 * | 6/2006 | Gelardi | B65D 83/0463 206/532 |
| 2006/0156553 | A1 | 7/2006 | Alvarez | |
| 2010/0083794 | A1 | 4/2010 | Galpin | |
| 2014/0197187 | A1 | 7/2014 | Perlmutter | |

FOREIGN PATENT DOCUMENTS

| | | |
|---|---|---|
| EP | 2557045 A2 | 2/2013 |

* cited by examiner

*Primary Examiner* — Hwei C Payer

(57) ABSTRACT

The condiment package opening device is a cutting tool. The condiment package opening device is configured for use with a soft-sided condiment package. The soft-sided condiment package is typically a sealed single serving package containing an edible substance that is intended: 1) to enhance the flavor of a food; and, 2) to be applied to the food after the food has been prepared for consumption but before the food is consumed. Typical condiments include, but are not limited to, mustard and ketchup. The condiment package opening device forms an opening in the soft-sided condiment package such that the condiment contained within the soft-sided condiment package may be removed through the formed opening. The condiment package opening device comprises a cutting mechanism and an optional housing.

3 Claims, 5 Drawing Sheets

CONDIMENT PACKAGE OPENING DEVICE

CROSS REFERENCES TO RELATED APPLICATIONS

Not Applicable

STATEMENT REGARDING FEDERALLY SPONSORED RESEARCH

Not Applicable

REFERENCE TO APPENDIX

Not Applicable

BACKGROUND OF THE INVENTION

Field of the Invention

The present invention relates to the field of shaping and tools, more specifically, a handheld cutting tool not otherwise provided for.

SUMMARY OF INVENTION

The condiment package opening device is a cutting tool. The condiment package opening device is configured for use with a soft-sided condiment package. The soft-sided condiment package is typically a sealed single serving package containing an edible substance that is intended: 1) to enhance the flavor of a food; and, 2) to be applied to the food after the food has been prepared for consumption but before the food is consumed. Typical condiments include, but are not limited to, mustard and ketchup. The condiment package opening device forms an opening in the soft-sided condiment package such that the condiment contained within the soft-sided condiment package may be removed through the formed opening. The condiment package opening device comprises a cutting mechanism and an optional housing.

These together with additional objects, features and advantages of the condiment package opening device will be readily apparent to those of ordinary skill in the art upon reading the following detailed description of the presently preferred, but nonetheless illustrative, embodiments when taken in conjunction with the accompanying drawings.

In this respect, before explaining the current embodiments of the condiment package opening device in detail, it is to be understood that the condiment package opening device is not limited in its applications to the details of construction and arrangements of the components set forth in the following description or illustration. Those skilled in the art will appreciate that the concept of this disclosure may be readily utilized as a basis for the design of other structures, methods, and systems for carrying out the several purposes of the condiment package opening device.

It is therefore important that the claims be regarded as including such equivalent construction insofar as they do not depart from the spirit and scope of the condiment package opening device. It is also to be understood that the phraseology and terminology employed herein are for purposes of description and should not be regarded as limiting.

BRIEF DESCRIPTION OF DRAWINGS

The accompanying drawings, which are included to provide a further understanding of the invention are incorporated in and constitute a part of this specification, illustrate an embodiment of the invention and together with the description serve to explain the principles of the invention. They are meant to be exemplary illustrations provided to enable persons skilled in the art to practice the disclosure and are not intended to limit the scope of the appended claims.

DETAILED DESCRIPTION OF THE EMBODIMENT

Figure 1:
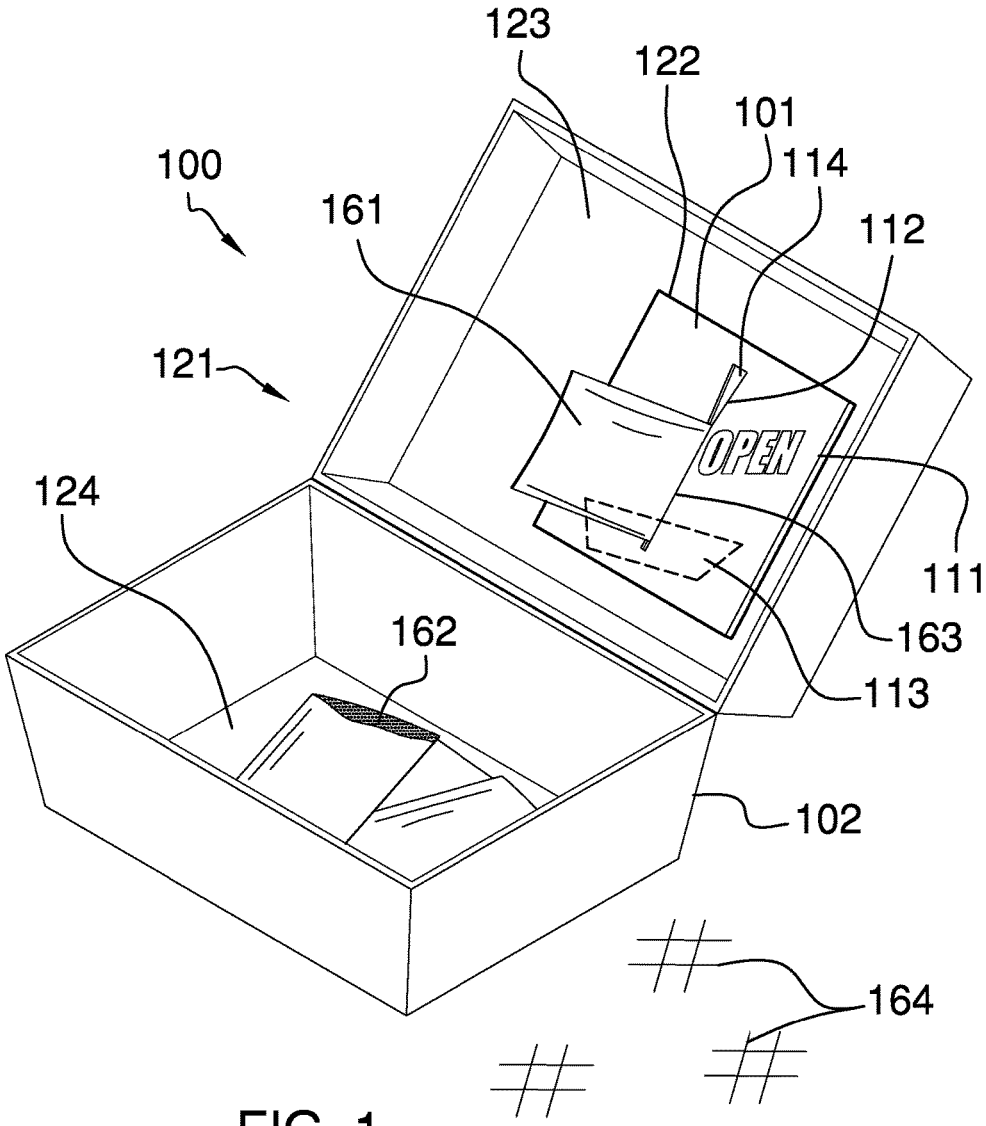
FIG. 1 is a perspective view of an embodiment of the disclosure.
Figure 2:
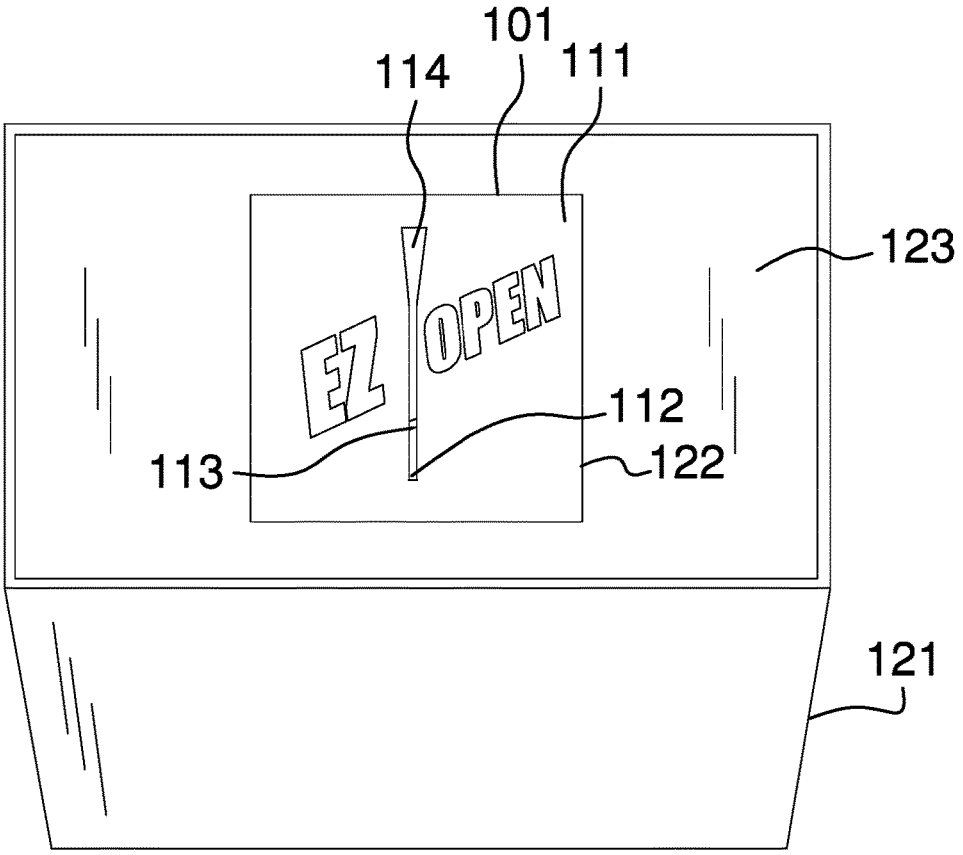
FIG. 2 is a front view of an embodiment of the disclosure.
Figure 3:
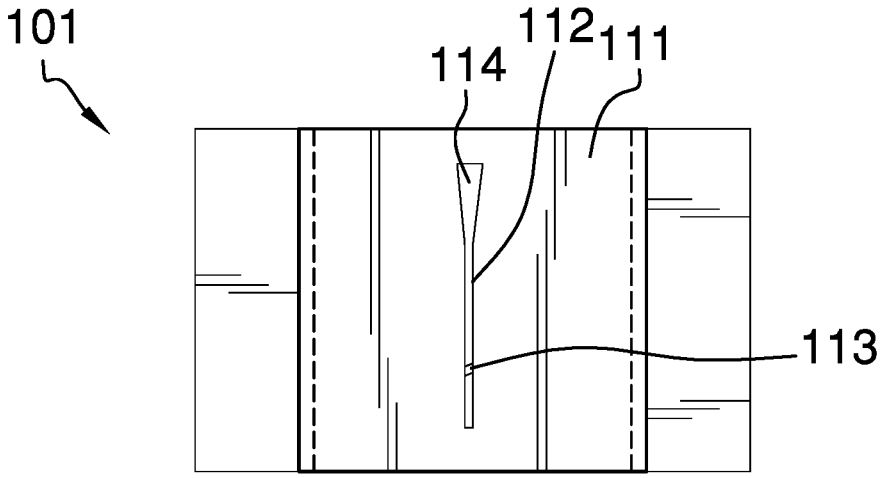
FIG. 3 is a top view of an alternate embodiment of the disclosure.
Figure 4:
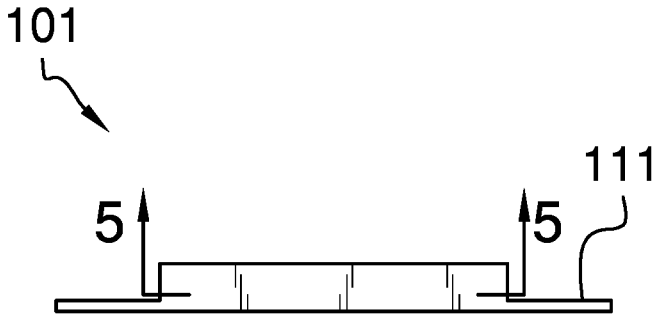
FIG. 4 is a front view of an alternate embodiment of the disclosure.

The following detailed description is merely exemplary in nature and is not intended to limit the described embodiments of the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to practice the disclosure and are not intended to limit the scope of the appended claims. Furthermore, there is no intention to be bound by any expressed or implied theory presented in the preceding technical field, background, brief summary or the following detailed description.

Detailed reference will now be made to one or more potential embodiments of the disclosure, which are illustrated in FIGS. 1 through 7.

The condiment package opening device 100 (hereinafter invention) is a cutting tool. The invention 100 is configured for use with a soft-sided condiment package 161. The soft-sided condiment package 151 is typically a sealed single serving package containing an edible substance that is intended: 1) to enhance the flavor of a food; and, 2) to be applied to the food after the food has been prepared for consumption but before the food is consumed. Typical condiments include, but are not limited to, mustard and ketchup. The invention 100 forms an opening 162 in the soft-sided condiment package 161 such that the condiment contained within the soft-sided condiment package 161 may be removed through the formed opening 162. The invention 100 comprises a cutting mechanism 101 and an optional housing 102.

The soft-sided condiment package 161 is further defined with a targeted edge 163. The targeted edge 163 is the edge of the soft-sided condiment package 161 that is to have an opening 162 formed in it. The opening 162 can be formed by slicing off the targeted edge 163 or by puncturing the targeted edge 163.

The cutting mechanism 101 is a mechanical device that is used to create the opening 162 within the soft-sided condiment package 161. The cutting mechanism 101 comprises a plate 111, a slot 112, and a cutting blade 113. The plate 111 is a flat rectangular block structure through which the slot 112 is formed and on which the cutting blade 113 is mounted. The slot 112 is an aperture that is formed through the plate 111. The slot 112: 1) is sized to receive the targeted edge 163 of the soft-sided condiment package 161; and, 2) is intended to guide the targeted edge 163 of the soft-sided condiment package 161 to the cutting blade 113. The cutting blade 113 is a razor. The cutting blade 113 is mounted across the slot 112 such that the targeted edge 163 of the soft-sided condiment package 161 will be guided to the cutting blade 113 by the slot 112. The targeted edge 163 of the soft-sided condiment package 161 will be removed by the cutting blade 113 when the targeted edge 163 of the soft-sided condiment package 161 is pulled across the cutting blade 113.

Figure 5:
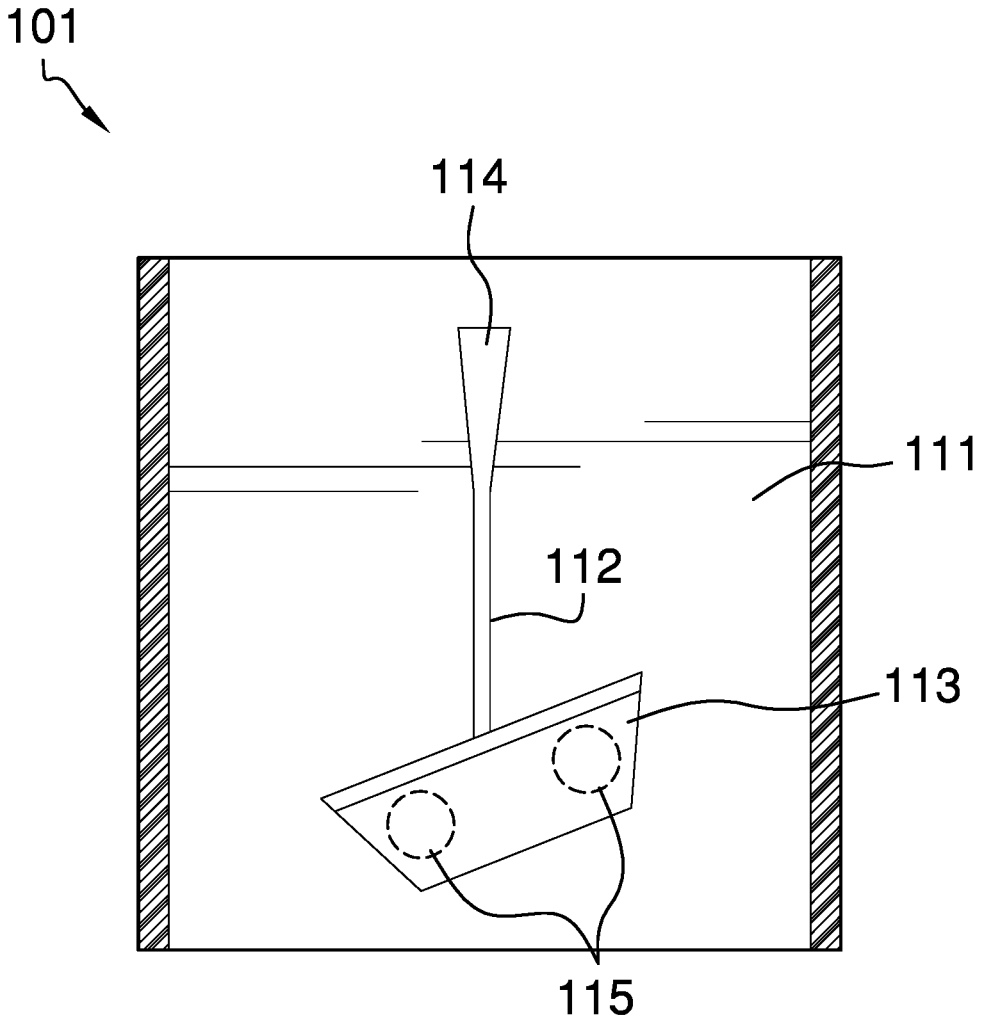
FIG. 5 is a cross-sectional view of an alternate embodiment of the disclosure across 5-5 as shown in FIG. 4.
Figure 6:
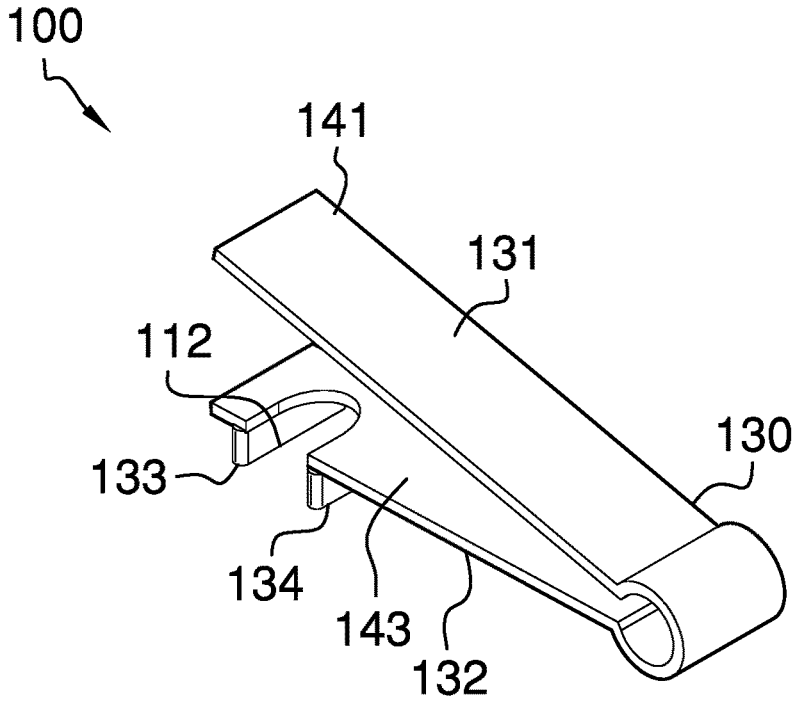
FIG. 6 is a perspective view of an alternate embodiment of the disclosure.
Figure 7:
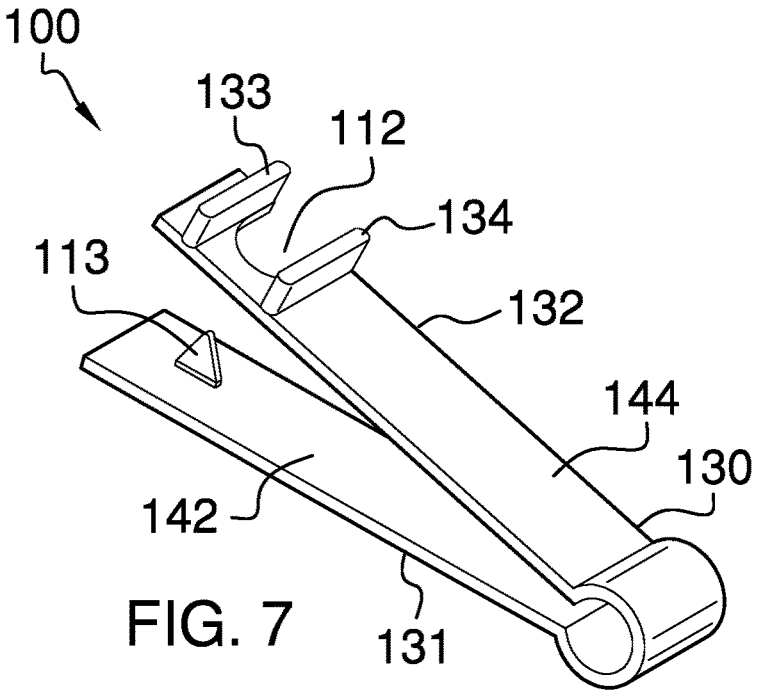
FIG. 7 is a reverse perspective view of an alternate embodiment of the disclosure.

As shown most clearly in FIGS. 1 and 5, in the first potential embodiment of the disclosure, the cutting blade 113 is mounted across the slot 112 such that the edge of the cutting blade 113 is neither: 1) perpendicular to the sense of direction of the slot 112; nor, 2) parallel to the sense of direction of the slot 112. As shown most clearly in FIGS. 1 and 5, the end of the slot 112 that is distal from the cutting blade 113 is formed with a triangular flair 114 that widens the slot 112 in a manner that simplified the insertion of the targeted edge 163 into the slot 114. As shown most clearly in FIG. 5, in the first potential embodiment of the disclosure the cutting blade 113 is held in position using an adhesive 115.

The housing 102 is an optional structure into which the cutting mechanism 101 is incorporated for use.

In the first potential embodiment of the disclosure, the housing 102 comprises a container 121. The container 121 is a hollow structure within which the targeted edge 163 of each soft-sided condiment package 161 that is cut by the cutting mechanism 101 is accumulated. The container 121 is further defined with a top surface 123 and a supported surface 124. The supported surface 124 is the surface of the container 121 that is placed upon a supporting surface 164. The top surface 123 is the surface of the container 121 that is distal from the supported surface 124. Depending on the application design, the top surface 123 may or may not be removable from the container 121.

The container 121 further comprises a mounting aperture 122. The mounting aperture 122 is a port that is formed through the top surface 123 of the container 121. The mounting aperture 122 is sized such that the plate 111 of the cutting mechanism 101 can be mounted with the mounting aperture 122. As shown most clearly in FIG. 1, the cutting mechanism 101 is mounted in the mounting aperture 122.

A second potential embodiment of the disclosure is identical to the first potential embodiment of the disclosure with the following modification: the container 121 is a disposable structure such that the waste generated by the invention 100 is accumulated within the container 121 and is simply disposed of after use.

To use the first potential embodiment of the disclosure and the second potential embodiment of the disclosure, the targeted edge 163 of the soft-sided condiment package 161 is inserted into the slot 112 of the cutting mechanism 101. The targeted edge 163 of the soft-sided condiment package 161 is then drawn across the cutting blade 113 such that the targeted edge 163 is sliced off the soft-sided condiment package 161.

In a third potential embodiment of the disclosure, the housing 102 comprises a cantilever V spring 130. The cantilever V spring 130 is a spring based device. The cantilever V spring 130 is described in detail elsewhere in this disclosure.

The cantilever V spring 130 comprises a first cantilever 131 and a second cantilever 132. The first cantilever 131 is further defined with a first interior surface 141 and a first exterior surface 142. The first exterior surface 142 of the first cantilever 131 is the surface that is distal from the first interior surface 141 of the first cantilever 131. The second cantilever 132 is further defined with a second interior surface 143 and a second exterior surface 144. The second exterior surface 144 of the second cantilever 132 is the surface that is distal from the second interior surface 143 of the second cantilever 132. As shown most clearly in FIGS. 6 and 7, the first interior surface 141 of the first cantilever 131 faces the second interior surface 143 of the second cantilever 132.

The first cantilever 131 is a first arm of the cantilever V spring 130. As shown most clearly in FIGS. 6 and 7, the first cantilever 131 is a first rectangular beam structure that is modified as described elsewhere within this disclosure. The second cantilever 132 is a second arm of the cantilever V spring 130. In the third potential embodiment of the disclosure, the second cantilever 132 forms the plate 111 of the invention 100. As shown most clearly in FIGS. 6 and 7, the second cantilever 132 is a second rectangular beam structure that is modified as described elsewhere within this disclosure.

The first cantilever 131 is a first rectangular beam structure that further comprises the cutting blade 113. As shown most clearly in FIGS. 6 and 7, the first cutting blade 113 projects perpendicularly away from the first interior surface 141 of the first cantilever 131.

The second cantilever 132 is a second rectangular beam structure that further comprises the slot 112, a first offset leg 133, and a second offset leg 134. As shown most clearly in FIGS. 6 and 7, in the third potential embodiment of the disclosure, the slot 112 is a semicircular notch. The cutting blade 113 is positioned on the first cantilever 131 such when the first cantilever 131 is pressed against the second cantilever 132 the cutting blade 113 will fit into the slot 112.

The first offset leg 133 is a ridge that is formed on the second exterior surface 144 of the second cantilever 132. The purpose of the first offset leg 133 is to raise the second cantilever 132 above the supporting surface 164 such that the cutting blade 113 will not pass through the slot 112 in a manner that damages the supporting surface 164 during use of the invention 100.

The second offset leg 134 is a ridge that is formed through the second interior surface 143 and the second exterior surface 144 of the second cantilever 132. The purpose of the second offset leg 134 is to raise the second cantilever 132 above the supporting surface 164 such that the cutting blade 113 will not pass through the slot 112 in a manner that damages the supporting surface 164 during use of the invention 100.

To use the third potential embodiment of the disclosure, the soft-sided condiment package 161 is placed on the second interior surface 143 of the second cantilever 132 such that the targeted edge 163 is positioned over the slot 112. The first interior surface 141 is pressed against the second interior surface 143 such that the cutting blade 113 of the first cantilever 131 will puncture the targeted edge 163 of the soft-sided condiment package 161. The soft-sided condiment package 161 can then be drawn across the cutting blade 113 in a manner that slices the targeted edge 163 off the soft-sided condiment package 161 in order to form the opening 162. For safety purposes, it is preferred that the second exterior surface 144 of the second cantilever 132, the first offset leg 133 of the second cantilever 132 and the second offset leg 134 of the second cantilever 132 be placed on the supporting surface 164 before the third potential embodiment of the disclosure is used.

The following definitions were used in this disclosure:

Adhesive: As used in this disclosure, an adhesive is a chemical substance that can be used to adhere two or more objects to each other. Types of adhesives include, but are not limited to, epoxies, polyurethanes, polyimides, or cyanoacrylates, silicone, or latex based adhesives.

Blade: As used in this disclosure, a blade is a term that is used to describe: 1) a wide and flat portion of a structure; or, 2) the cutting edge of a tool.

Cantilever: As used in this disclosure, a cantilever is a beam or other structure that projects away from an object and is supported on only one end.

Cantilever V Spring: As used in this disclosure, a cantilever V spring is a torsion spring that is formed in a chevron shape. The cantilever V spring comprises a first cantilever structure and a second cantilever structure wherein the fixed end of the first cantilever structure is attached to the fixed end of the second cantilever structure. Within this structure, when a force is applied to the cantilever V spring such that the first cantilever structure moves towards the second cantilever structure the force deforms the cantilever V spring in an elastic manner that: 1) resists the application of the force; and 2) stores the energy deformation such that when the force is no longer applied the cantilever V spring returns to its relaxed shape. Depending on the application, a cantilever V spring can be considered a torsion spring or a compression spring.

Chevron: As used in this disclosure, chevron is a term that is used to describe an object that has the shape of a V.

Compression Spring: As used in this disclosure, a compression spring is a wire coil that resists forces attempting to compress the wire coil in the direction of the center axis of the wire coil. The compression spring will return to its original position when the compressive force is removed.

Exterior: As used in this disclosure, the exterior is use as a relational term that implies that an object is not contained within the boundary of a structure or a space.

Handheld: As used in this disclosure, when referring to an item or device, handheld means that the item or device is small and light enough to be operated while a person holds the item or device in their hands.

Interior: As used in this disclosure, the interior is use as a relational term that implies that an object is contained within the boundary of a structure or a space.

Plate: As used in this disclosure, a plate is a smooth, flat and rigid object that has at least one dimension that: 1) is of uniform thickness; and 2) that appears thin relative to the other dimensions of the object. Plates often have a rectangular or disk like appearance. As defined in this disclosure, plates may be made of any material, but are commonly made of metal.

Relaxed Shape: As used in this disclosure, a structure is considered to be in its relaxed state when no shear, strain, or torsional forces are being applied to the structure.

Ridge: As used in this disclosure, a ridge is an elevated or raised portion of a structure.

Slot: As used in this disclosure, a slot is a long narrow groove or aperture that is formed in an object.

Spring: As used in this disclosure, a spring is a device that is used to store mechanical energy. This mechanical energy will often be stored by: 1) deforming an elastomeric material that is used to make the device; 2) the application of a torque to a rigid structure; or 3) a combination of the previous two items.

Torsion Spring: As used in this disclosure, a torsion spring is a mechanical device that stores mechanical energy through an opposing torque when the mechanical device is twisted. The torsion spring will return to its original position when the twisting force is removed.

With respect to the above description, it is to be realized that the optimum dimensional relationship for the various components of the invention described above and in FIGS. 1 through 7 include variations in size, materials, shape, form, function, and manner of operation, assembly and use, are deemed readily apparent and obvious to one skilled in the art, and all equivalent relationships to those illustrated in the drawings and described in the specification are intended to be encompassed by the invention.

It shall be noted that those skilled in the art will readily recognize numerous adaptations and modifications which can be made to the various embodiments of the present invention which will result in an improved invention, yet all of which will fall within the spirit and scope of the present invention as defined in the following claims. Accordingly, the invention is to be limited only by the scope of the following claims and their equivalents.

What is claimed is:

1. A handheld cutting tool comprising:

a cutting mechanism;

wherein the handheld cutting tool is configured for use with a soft-sided condiment package;

wherein the handheld cutting tool forms an opening in the soft-sided condiment package;

wherein the soft-sided condiment package is further defined with a targeted edge;

wherein the cutting mechanism is a mechanical device that is used to create the opening within the soft-sided condiment package;

wherein the cutting mechanism comprises a plate, a slot, and a cutting blade;

wherein the slot is an aperture formed through the plate;

wherein the cutting blade is attached to the plate such that the cutting blade lies across the slot;

wherein the slot is sized to receive the targeted edge of the soft-sided condiment package;

wherein the slot guides the targeted edge of the soft-sided condiment package to the cutting blade;

wherein the cutting blade is a razor;

wherein the cutting blade is mounted across the slot such that the targeted edge of the soft-sided condiment package will be guided to the cutting blade by the slot;

wherein the cutting blade is mounted across the slot such that a cutting edge of the cutting blade is not perpendicular to an extending direction of the slot;

wherein the cutting blade is mounted across the slot such that the cutting edge of the cutting blade is not parallel to the extending direction of the slot;

wherein the end of the slot that is distal from the cutting blade is formed with a triangular flair;

wherein the handheld cutting tool further comprises a housing;

wherein the housing is a structure;

wherein the cutting mechanism is incorporated into the housing;

wherein the housing comprises a container;

wherein the container is a hollow structure;

wherein the container is further defined with a top surface and a supported surface;

wherein the supported surface is the surface of the container that is placed upon a supporting surface;

wherein the top surface is the surface of the container that is distal from the supported surface;

wherein the container further comprises a mounting aperture;

wherein the mounting aperture is a port that is formed through the top surface of the container;

wherein the mounting aperture is sized such that the plate of the cutting mechanism can be mounted with the mounting aperture;

wherein the cutting mechanism is mounted in the mounting aperture.

2. The handheld cutting tool according to claim 1 wherein the container is disposable.

3. The handheld cutting tool according to claim 2 wherein the cutting blade is held in position using an adhesive.

* * * * *